US007071838B2

(12) United States Patent
Brown et al.

(10) Patent No.: US 7,071,838 B2
(45) Date of Patent: Jul. 4, 2006

(54) COUPLING SIGNALS VIA A COUPLING ARRANGEMENT

(75) Inventors: David Alan Brown, Carp (CA); Mircea Cristian Boros, Ottawa (CA)

(73) Assignee: Potentia Semiconductor, Inc., Wilmington, DE (US)

( * ) Notice: Subject to any disclaimer, the term of this patent is extended or adjusted under 35 U.S.C. 154(b) by 502 days.

(21) Appl. No.: 10/428,102

(22) Filed: May 2, 2003

(65) Prior Publication Data

US 2004/0217743 A1 Nov. 4, 2004

(51) Int. Cl.
*G08C 19/06* (2006.01)

(52) U.S. Cl. ..... 340/870.41; 340/10.34; 307/107

(58) Field of Classification Search ..... 307/107, 307/13, 17; 340/870.41, 10.34; 375/36, 375/258
See application file for complete search history.

(56) References Cited

U.S. PATENT DOCUMENTS 4,188,619 A * 2/1980 Perkins ..... 307/3
4,254,402 A * 3/1981 Perkins ..... 307/3
4,481,501 A * 11/1984 Perkins ..... 307/13
4,758,836 A * 7/1988 Scuilli ..... 340/870.31
5,612,684 A 3/1997 Kelly et al. ..... 340/870.31
5,949,659 A * 9/1999 Lesche ..... 363/16
6,850,048 B1 * 2/2005 Orr et al. ..... 323/299
6,911,746 B1 * 6/2005 Orr et al. ..... 307/107

* cited by examiner

*Primary Examiner*—Bao Q. Vu

(57) ABSTRACT

A power supply controller has two control units for coupling to primary and secondary sides of controlled power supplies, the units being coupled via a transformer which couples signals between the units, a power supply voltage for the secondary-side unit being derived from signals coupled from the primary-side unit. Initially signals are coupled from the primary unit with an increasing duty cycle to charge a secondary-side power supply capacitor. Subsequently signals are coupled in signal frames in alternating directions between the units, each signal frame from each unit indicating whether or not signal frames are correctly received from the other control unit. The signal frames also provide for downloading information for the control units, and other status signals and commands and acknowledgements.

21 Claims, 3 Drawing Sheets

COUPLING SIGNALS VIA A COUPLING ARRANGEMENT

This invention relates to coupling signals via a coupling arrangement. The invention is particularly concerned with coupling signals in both directions between first and second control units of a power supply controller via a transformer coupling arrangement, a power supply for the second control unit being derived from signals coupled from the first control unit to the second control unit.

REFERENCE TO RELATED APPLICATIONS

Reference is directed to the following copending U.S. Patent Applications filed simultaneously herewith, the entire disclosure of each of which is hereby incorporated herein by reference:

"Power Supply Controller", R. Orr et al., (79115-8, PP010);

"Sequencing Power Supplies", D. Brown et al., (79115-20, PP011);

"Signal And Power Transformer Coupling Arrangements", R. Orr et al., (79115-4, PP005);

"Transformer Coupling Arrangement And Method Using A Plurality Of Drivers", D. Brown, (79115-17, PP016).

BACKGROUND

The related applications describe and claim a power supply controller, and various features thereof, which can be used for controlling a plurality of isolating power supplies, such as switch mode power supplies or DC power converters, for providing controlled electrical power to loads. For example, the power supplies may provide different supply voltages to various electrical circuits on a circuit card on which the power supply controller is also provided.

In such a power supply controller, separate IC (integrated circuit) control units can be provided on the primary and secondary sides of a transformer that serves to maintain an electrical isolation barrier between input and output sides of the isolating power supplies. The transformer conveniently provides for signal coupling in both directions between the primary and secondary control units, and also for power transfer from its primary to its secondary side to supply operating power to the secondary control unit and any related circuits (for example, a non-volatile memory) of the power supply controller on the secondary side of the transformer.

Such an arrangement provides significant advantages, for example in requiring only a single transformer to provide electrical isolation between the primary and secondary sides while providing desired bidirectional signal coupling as well as supplying power to the secondary control unit. However, it also requires an effective method for reliably establishing the signal coupling, initially supplying power to the secondary control unit on start-up, ensuring on start-up that the control units are operable to control the isolating power supplies before they can supply power to their loads, and maintaining coordinated operating states of the control units despite errors that may occur in the signal coupling or otherwise.

There is a need to meet these requirements.

SUMMARY OF THE INVENTION

According to one aspect of this invention there is provided a method of coupling signals between first and second units via a transformer, comprising the steps of: deriving a power supply for the second unit from signals coupled from the first unit to the second unit; initially coupling signals via the transformer from the first unit to the second unit to charge a power supply capacitor of the second unit thereby to produce a power supply voltage for the second unit; subsequently coupling signals in signal frames from the first unit to the second unit; and in response to signal frames received by the second unit from the first unit, coupling signals in signal frames from the second unit to the first unit; wherein the signal frames coupled from each unit comprise a signal indicating whether or not signal frames are correctly received from the other unit.

In order to limit current on initially charging the power supply capacitor of the second unit, preferably a duty cycle of the signals coupled initially from the first unit to the second unit is progressively increased from a relatively small value.

Desirably the signal frames are coupled alternately in opposite directions from each unit, and each unit can provide a delay after receiving a signal frame from the respective other unit before coupling a signal in the opposite direction to the respective other unit.

The second unit can operate asynchronously to the first unit, in which case preferably the method includes the steps of: determining a ping-pong period in the first unit, each signal frame coupled from the first unit to the second unit being provided in a first part of the ping-pong period; and following receipt of a signal frame coupled from the second unit to the first unit in a second part of the ping-pong period following the first part of the ping-pong period, coupling a fill signal from the first unit to the second unit for any remainder of the ping-pong period. The fill signal in this case enhances the supply of power from the first unit to the second unit.

The signal frames coupled from each unit can further comprise a signal indicating whether or not the respective unit has a proper supply voltage; a signal indicating whether or not the respective unit is ready for normal operation; and/or a plurality of signals indicating commands issued by the respective unit and acknowledgements of said commands by the respective other unit. Where the first and second units comprise control units for coupling to primary and secondary sides, respectively, of a plurality of isolating power supplies, the commands can comprise control signals for said isolating power supplies.

The signal frames coupled from the second unit to the first unit can comprise addresses and data for transferring information stored in a non-volatile memory via the transformer to the first unit; a power supply to the non-volatile memory can also be derived from said power supply capacitor.

Another aspect of the invention provides a method of operating a power supply controller comprising first and second control units for coupling to primary and secondary sides, respectively, of a plurality of isolating power supplies controlled by the power supply controller, the first and second control units being coupled via a transformer for coupling signals in both directions between the first and second control units and for producing a power supply for the second control unit from signals coupled from the first control unit to the second control unit, comprising the steps of: initially coupling signals via the transformer from the first control unit to the second control unit to charge a power supply capacitor of the second control unit thereby to produce a power supply voltage for the second control unit; and subsequently coupling signals, for operation of the control units to control the plurality of isolating power supplies by the power supply controller, in signal frames in alternating directions between the first and second control units, the signal frames coupled from each control unit comprising a signal indicating whether or not signal frames are correctly received from the other control unit.

For example, the signal frames coupled from the second control unit to the first control unit can comprise a plurality of signals indicating commands for respective isolating power supplies, the signal frames coupled from the first control unit to the second control unit comprising a corresponding plurality of signals indicating acknowledgements of said commands.

Further, the signal frames coupled from the first control unit to the second control unit can comprise at least one signal indicating enable and shut-down commands for the isolating power supplies, the signal frames coupled from the second control unit to the first control unit comprising at least one corresponding signal indicating an acknowledgement of said commands.

BRIEF DESCRIPTION OF THE DRAWINGS

The invention will be further understood from the following description by way of example with reference to the accompanying drawings, in which.

DETAILED DESCRIPTION

Figure 1:
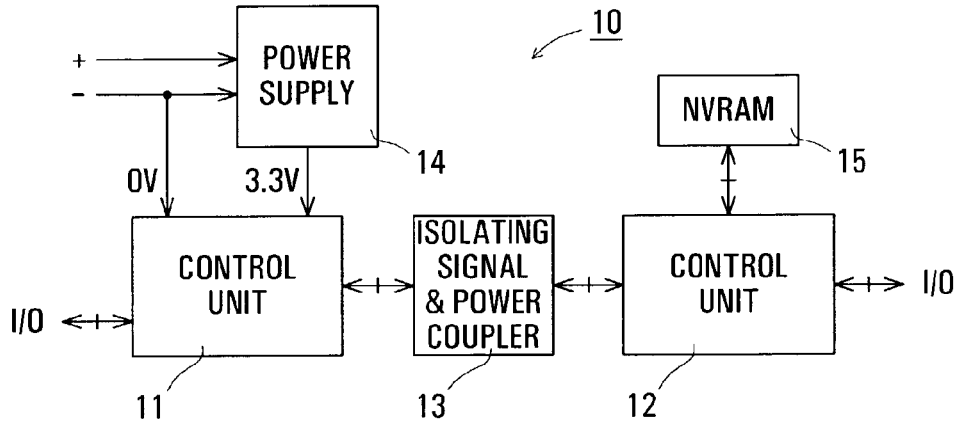
FIG. 1 shows a block diagram of a power supply controller.

Referring to FIG. 1, a power supply controller 10 is illustrated for controlling a plurality of isolating power supplies (not shown) to which the power supply controller is connected via I/O (input and/or output) ports of two control units 11 and 12. By way of example, the power supply controller 10 and the isolating power supplies that it controls may all be provided on a circuit card (not shown), which also includes electrical circuits (not shown) constituting loads to be powered by the power supplies. In use, the circuit card is inserted in an equipment slot and thereby connected to a backplane (not shown) which provides connections to a power source, for example a nominally 48 volt source via connections + and − in FIG. 1.

Via the I/O ports of the control units 11 and 12, the power supply controller 10 can for example monitor the source voltage, monitor and adjust the output voltages of the controlled power supplies, and control sequencing of the power supplies via enable inputs of the power supplies. These functions generally require connections of the power supply controller 10 to both the primary and secondary sides of the isolating power supplies which it controls. In order to maintain electrical isolation between the primary and secondary sides, connections to the primary side are made from the control unit 11, connections to the secondary side are made from the control unit 12, and the two control units communicate with one another via a bidirectional isolating signal and power coupler 13 between them, the coupler 13 also forming a part of the power supply controller 10.

For simplicity and convenience, and for consistency with the terminology used for the isolating power supplies, the control units 11 and 12 are also referred to as first and second units respectively, or as primary and secondary control units respectively; the respective sides of the coupler 13 are also referred to as primary and secondary sides. In addition, drawing references below use suffixes -P and -S to denote similar components on respectively the primary and secondary sides of the power supply controller 10.

As illustrated in FIG. 1, the power supply controller 10 also comprises a power supply 14 and a non-volatile random access memory (NVRAM) 15. The source voltage is supplied to the power supply 14, which provides a supply voltage to the control unit 11. The power supply 14 can for example be a current mode flyback power supply to provide sufficient power for the power supply controller 10, with a start-up circuit provided by a depletion mode MOSFET, and for example provides a supply voltage of 3.3 volts to the control unit 11.

The coupler 13 not only provides for bidirectional signal coupling between the control units 11 and 12, but also couples power in an isolated manner from the control unit 11 to the control unit 12, this coupled power serving to supply operating power to the secondary side of the power supply controller 10, including the control unit 12 and the NVRAM 15. The NVRAM 15 serves to store information used in operation of the power supply controller 10, this information being transferred to shadow registers in the control units 11 and 12 on power-up of the power supply controller 10.

All of the components 11 to 15 of the power supply controller 10 are desirably integrated into a single package, in which each of the control units 11 and 12 conveniently comprises an application-specific IC (ASIC).

Figure 2:
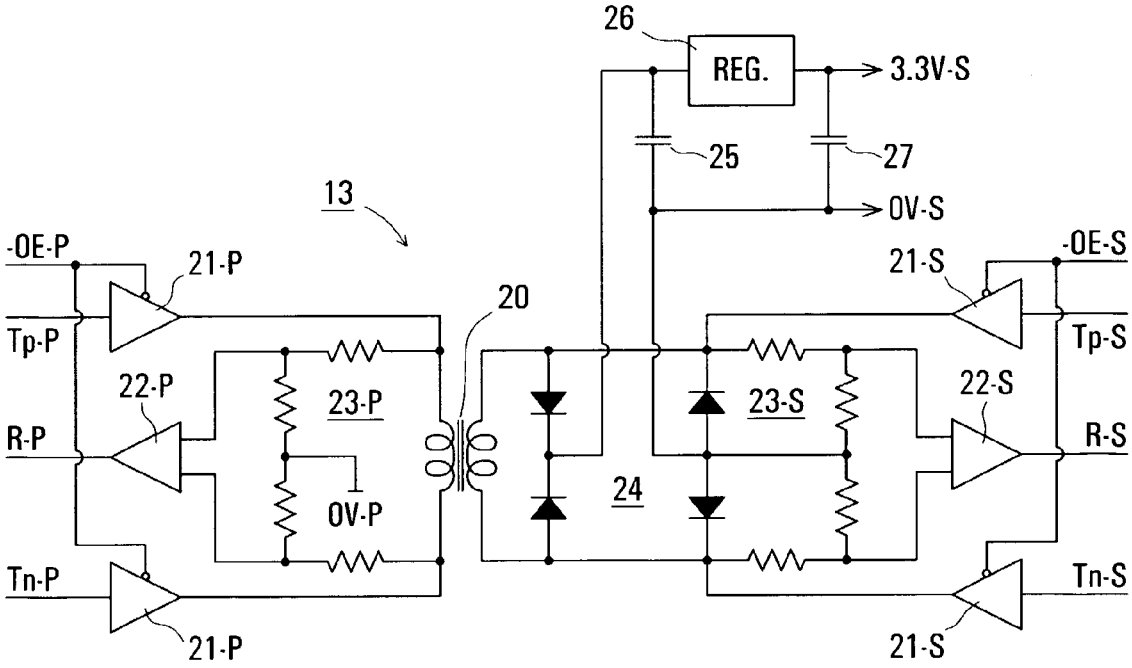
FIG. 2 schematically illustrates an isolating signal and power coupler of the power supply controller of FIG. 1.

Referring to FIG. 2, one form of the isolating signal and power coupler 13 comprises a transformer 20 with primary and secondary windings which are coupled to transmit-receive units of the control units 11 and 12 respectively.

On the primary side, the transmit-receive unit of the control unit 11 comprises differential signal transmit buffers 21-P, a differential signal receiver 22-P, and a balanced resistive potential divider 23-P. To provide a sufficient current drive to the transformer to power the secondary side of the power supply controller as described further below, each of the transmit buffers 21-P may comprise a plurality of buffers or drivers connected in parallel with one another. The transmit buffers 21-P couple differential signals Tp-P and Tn-P supplied to their inputs via their outputs, when an active-low output enable (OE) signal -OE-P is low, to the primary winding of the transformer 20.

When the OE signal -OE-P is high, the outputs of the transmit buffers 21-P have a high impedance, and a signal received from the secondary side of the transformer 20 can be coupled via the resistive potential divider 23-P to the inputs of the differential signal receiver 22-P, which produces at its output a receive signal R-P for the control unit 11.

Similarly, on the secondary side, the transmit-receive unit of the control unit 12 comprises differential signal transmit buffers 21-S, a differential signal receiver 22-S, and a balanced resistive potential divider 23-S. The transmit buffers 21-S (which in this embodiment need not comprise a plurality of drivers in parallel because they are not required for power transfer) couple differential signals Tp-S and Tn-S supplied to their inputs via their outputs, when an active-low output enable (OE) signal -OE-S is low, to the secondary winding of the transformer 20. When the OE signal -OE-S is high, the outputs of the transmit buffers 21-S have a high impedance, and a signal received from the primary side of the transformer 20 can be coupled via the resistive potential divider 23-S to the inputs of the differential signal receiver 22-S, which produces at its output a receive signal R-S for the control unit 12.

The secondary side of the coupler 13 also includes a diode bridge 24 having an ac input connected to the secondary winding of the transformer 20, a filter capacitor 25 connected to a dc output of the diode bridge, a low drop out (LDO) voltage regulator 26, and a further capacitor 27, for producing a supply voltage for the control unit 12 and NVRAM 15.

By way of example, with the primary side supply voltage of 3.3 volts as described above, the transformer 20 can have a primary to secondary turns ratio of 3:5, and the regulator 26 can provide a secondary side supply voltage 3.3V-S also of 3.3 volts. Zero voltages 0V-P and 0V-S on the primary and secondary sides of the transformer 20 are also illustrated in FIG. 2, these being isolated from one another to maintain the electrical isolation between the primary and secondary.

The resistive potential dividers 23-P and 23-S are designed to provide large differential signals (greater than 1.5 volts) at the inputs of the receivers 22, while limiting input voltage swings to a range of 0 to 3.3 volts. For example, all of the resistors of the potential divider 23-P can have the same resistance R, for example 5.7 kΩ; the two resistors of the potential divider 23-S connected to the transformer secondary winding can each have a resistance 4.5R, and the other two resistors of the potential divider 23-S can each have a resistance R.

Figure 3:
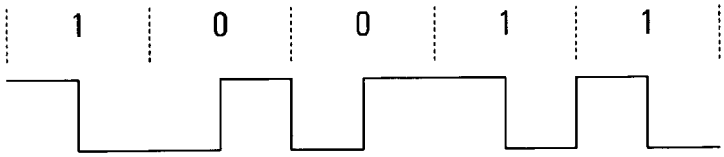
FIG. 3 PRIOR ART
FIG. 3 illustrates a known Manchester coded data sequence.

Conveniently, Manchester code is used for the signals, to avoid transformer saturation and to facilitate simple clock recovery. For example, FIG. 3 illustrates a waveform of a bit sequence 10011 which is Manchester encoded in known manner. The waveform has equal periods of logic 1 and 0 levels during each bit duration, so that there is no DC component supplied to the transformer 20. For each bit there is a transition of the waveform between logic levels at the centre of the bit. At transitions between bits, marked by dashed lines in FIG. 3, there is a transition if the consecutive bits are the same and no transition if the consecutive bits are different.

Signals are coupled between the control units 11 and 12 in opposite directions in an alternating or ping-pong manner with a timing determined by the control unit 11, as described further below with reference to FIG. 4. For signal coupling from the primary control unit 11 to the secondary control unit 12, the differential signal Tp-P, Tn-P is supplied from the control unit 11 to produce the signal R-S for the control unit 12, the outputs of the transmit buffers 21-P being enabled and the outputs of the transmit buffers 21-S being disabled at this time. This signal also provides for power transfer from the transmit buffers 21-P via the transformer 20 and the components 24 to 27 to produce the supply voltage for the control unit 12 and NVRAM 15. For signal coupling in the opposite direction from the secondary control unit 12 to the primary control unit 11, the differential signal Tp-S, Tn-S is supplied from the control unit 12 to produce the signal R-P for the control unit 11, the outputs of the transmit buffers 21-S being enabled and the outputs of the transmit buffers 21-P being disabled at this time.

Figure 4:
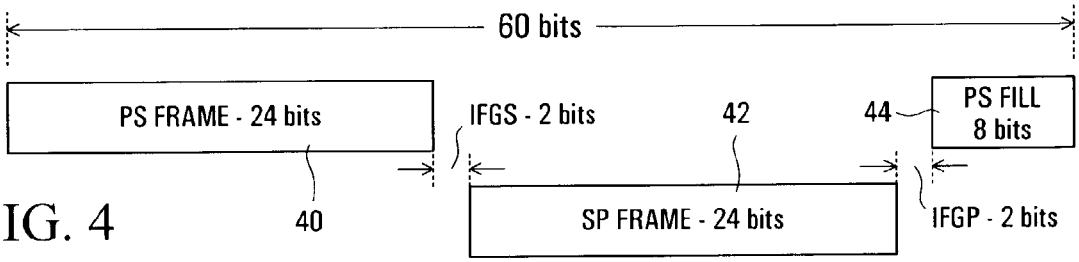
FIG. 4 illustrates coupling of signals in alternating directions via the coupler of FIG. 2 in accordance with an embodiment of the invention.

FIG. 4 illustrates this coupling of signals via the coupler 13 in alternating directions. In this example it is assumed that the control units 11 and 12 operate asynchronously relative to one another each with a frequency tolerance of ±5%, so that there may be a frequency difference of up to 10% between the two units.

Timing is determined by the primary control unit 11, and FIG. 4 shows on this timing basis one ping-pong period corresponding to a duration of 60 bits. During this period a primary-secondary (PS) frame 40 of 24 bits is coupled from the primary control unit 11 to the secondary control unit 12, and subsequently a secondary-primary (SP) frame 42 also of 24 bits is coupled from the secondary control unit 12 to the primary control unit 11. An inter-frame gap IFGS of nominally 2 bits duration follows the PS frame 40, and an inter-frame gap IFGP of 2 bits duration follows the SP frame 42. The inter-frame gaps help to prevent simultaneous driving of the transformer 20 by both of the control units 11 and 12.

The rest of the ping-pong period comprises a PS fill period 44 of nominally 8 bits duration, as further described below. It will be appreciated that because the secondary control unit 12 operates asynchronously relative to the primary control unit 11, the durations of the gap IFGS and the SP frame 42 can vary from their sizes as shown in FIG. 4. The duration of the PS fill period 44 varies accordingly. The ping-pong period shown in FIG. 4 is repeated cyclically.

During each inter-frame gap in the ping-pong period, there is a change in the direction of signal coupling via the transformer 20, and short-term oscillations can occur as the transformer magnetizing inductance discharges, after which differential voltage to the receivers 22 collapses. The differential receivers 22 are designed, for example with hysteresis, to allow for these factors. In addition, the frame details described below are selected to be tolerant of errors. Accordingly, the arrangement is tolerant of analog effects due to changing the direction of signal coupling via the transformer 20.

As indicated above, when a signal is coupled from the primary control unit 11 to the secondary control unit 12, i.e. during the PS frame 40, power is also coupled from the primary control unit 11 to charge the capacitor 25 and thereby produce the supply voltage for operation of the secondary control unit 12 and the NVRAM 15. In order to maximize the coupled power, and to minimize voltage sag of the capacitor 25, the PS fill period 44 is also used to couple an idle signal, for example all 1 bits, from the primary control unit 11 to the secondary control unit 12, and thereby also to couple power to the control unit 12 during this period.

Figure 5:
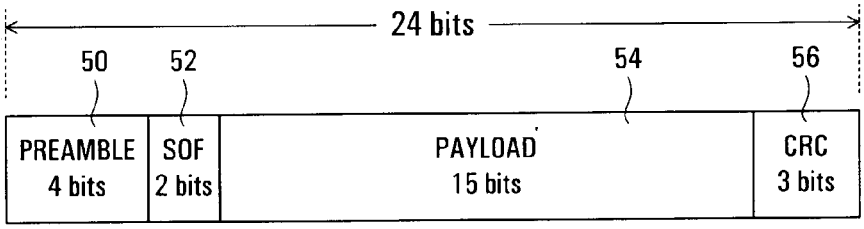
FIG. 5 illustrates a frame structure for the signal coupling in the timing diagram of FIG. 4.

FIG. 5 illustrates a frame structure for signal coupling in the PS and SP frames 40 and 42 of each ping-pong period. As described above, each such frame comprises 24 bits constituted by a preamble 50 of 4 bits, a start-of-frame (SOF) indication 52 of 2 bits, a payload 54 of 15 bits, and a payload cyclic redundancy check (CRC) 56 of 3 bits.

The preamble 50 for example comprises an alternating bit sequence 1010 for which the Manchester encoded waveform only has transitions at the centre of each bit, enabling the receiving control unit to determine the phase of the Manchester encoded data, this being necessary for each frame. To this end, the received differential signal is sampled at a rate of 6 times the nominal bit rate, thereby allowing for both the asynchronous operation of the control units and Nyquist sampling requirements, and the receiver locks onto the detected phase of the Manchester encoded data and maintains this phase alignment throughout the frame. A confidence count in the receiver is incremented with correct phase detections and decremented in the event of errors, the frame information being discarded unless the confidence count exceeds a threshold.

The 2-bit SOF indication 52 for example comprises an alternating bit sequence which is reversed relative to the preamble bit sequence; thus for the preamble bit sequence 1010 the SOF indication may be the bit sequence 01, enabling the receiver to determine the timing of the start of the payload 54. The payload 54 comprises a frame which can have any one of four frame types, these being a null frame, a control and status (C&S) frame, a serial interface address frame, or a serial interface data frame, as further described below.

Frames are allocated dynamically as serial interface frames or C&S frames, the serial interface having priority in order to minimize read and write times between the NVRAM 15 and the primary control unit 11. This is particularly important on start-up when the shadow registers of the primary control unit 11 are loaded with information from the NVRAM 15, as further described below. C&S frames are coupled continuously in normal operation in the absence of serial interface frames.

Figure 6:
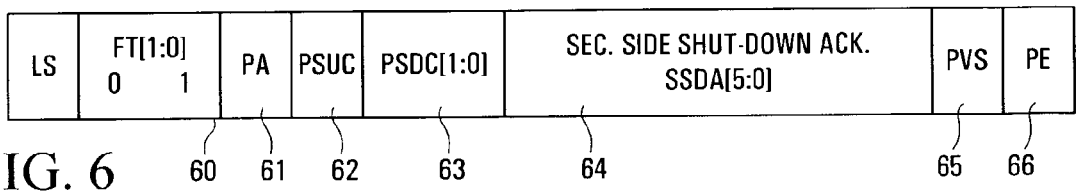
FIGS. 6, 7, and 8 illustrate different contents of the frame of FIG. 5 for coupling respective signals.
Figure 7:
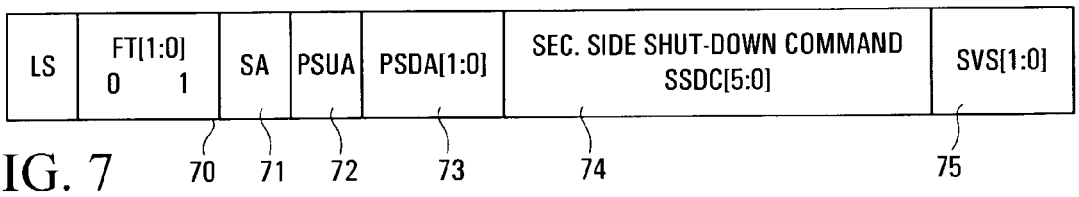
Figure 8:
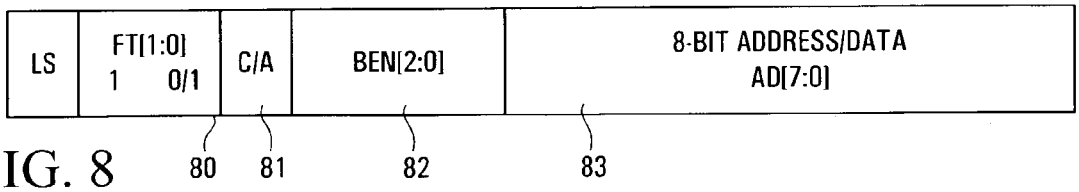

Each 15-bit payload frame comprises a link status bit LS, a 2-bit frame type, FT[1:0], and another 12 bits whose functions depend on the frame type and the direction in which the frame is coupled. For a null frame, the bits FT[1:0] are zero and the subsequent 12 bits are all zero. FIGS. 6, 7, and 8 illustrate different contents of the payload frames for other frame types and are further described below.

The link status bit LS is present as the first bit in each of the payload frames coupled in each direction via the coupler 13 or link, and represents whether (LS=1) or not (LS=0) the control unit sending the respective frame is correctly receiving frames. After start-up as further described below LS=1 in each frame to confirm correct operation. If a link error threshold is exceeded in either control unit, it sends frames with LS=0 to initiate a reset of both control units, which are then re-initialized in the same manner as the start-up sequence described below.

The 2-bit frame type also identifies the other types of frames, i.e. C&S, address, or data frames, as further described below. The address and data frames comprise addresses and data, respectively, for a serial interface between the NVRAM 15 and the control units 11 and 12. On start-up of the power supply controller 10, this serial interface is used to transfer information retained in the NVRAM 15 to shadow registers in the control units 11 (via the coupler 13) and 12 so that this information can be accessed without delays associated with the NVRAM 15; similarly, information can be transferred via the serial interface between the NVRAM 15 and the control units 11 (via the coupler 13) and 12 during operation of the power supply controller 10.

FIG. 6 illustrates a C&S frame 60 coupled in the primary to secondary direction, and FIG. 7 illustrates a C&S frame 70 coupled in the secondary to primary direction. In each case the bits FT[1:0] are 01 representing a C&S frame. In view of correspondence between the contents of these frames, they are described together. The frames are illustrated and described on the basis that the power supply controller 10 serves to control up to six power supplies, for each of which each of the control units 11 and 12 has a respective state machine.

Following the frame type, the frame 60 has a primary alive (PA) bit 61 which indicates to the secondary control unit 12 whether (PA=1) or not (PA=0) the primary control unit 11 which sends this frame is ready for normal operation. The frame 70 similarly has a secondary alive (SA) bit 71 which indicates to the primary control unit 11 whether (SA=1) or not (SA=0) the secondary control unit 12 which sends this frame is ready for normal operation.

The frame 60 then has a primary side start-up command (PSUC) bit 62, and a 2-bit primary side shut-down command PSDC[1:0] 63, which represent respectively start-up, fast shut-down, and slow shut-down commands of the primary control unit 11. The secondary control unit 12 responds to these and acknowledges them with respectively a primary side start-up acknowledge (PSUA) bit 72 and a 2-bit primary side shut-down acknowledgement PSDA[1:0] 73 in the frame 70.

Conversely, the frame 70 subsequently has a 6-bit secondary side shut-down command SSUC[5:0] 74, containing one bit for each of the six state machines and representing a shut-down command for the respective state machine and the power supply controlled thereby. The primary control unit 11 responds to these and acknowledges them with respective bits of a 6-bit secondary side shut-down acknowledgement SSDA[5:0] 64 in the frame 60.

Using these commands and acknowledgements, each of the control units 11 and 12 informs the other control unit of its operating state and commands, and acknowledges information received from the other control unit, so that both of the control units 11 and 12 are fully informed of operating states on both the primary and secondary sides, and can control the controlled power supplies accordingly.

The frame 60 further includes a primary side voltage status (PVS) bit 65 which indicates to the secondary control unit 12 whether or not the primary side supply voltage is good, and a primary side error (PE) bit 66 which indicates to the secondary control unit 12 whether or not errors in frames received from the secondary side exceed an error threshold.

The frame 70 further includes a 2-bit secondary side voltage status (SVS) 75. One of these bits indicates to the primary control unit 11 whether or not the secondary side supply voltage is good; the other indicates whether or not a restart condition, for enabling the power supplies controlled by the power supply controller 10, is satisfied. The secondary control unit 12 monitors the output voltage of each controlled power supply, and a power-up sequence for these controlled power supplies is only begun when the secondary control unit 12 has determined that all of the monitored output voltages have decayed to below respective thresholds, this constituting the restart condition.

FIG. 8 illustrates a serial interface frame 80 for either signal direction between the control units 11 and 12. For this frame 80 the bits FT[1:0] are 10 for an address frame or 11 for a data frame. Conveniently the serial interface is hosted by the NVRAM 15, which provides all address frames accordingly, so that only data serial interface frames need to be coupled from the primary control unit 11 to the secondary control unit 12.

Following the frame type, the frame 80 has a read/write command or acknowledge (C/A) bit 81, this bit being a command for frames from the secondary control unit 12 to the primary control unit 11 and an acknowledgement for frames coupled from the primary control unit 11 to the secondary control unit 12. This is followed by a 3-bit block enable BEN[2:0] 82 which identifies a respective one of a plurality of data banks in the shadow registers of the control units, and an 8-bit word AD[7:0] which constitutes a read/write address in an address frame, or a data word, read or to be written, in a data frame.

In order to establish the operation of the control units 11 and 12 and the signal and power coupling via the coupler 13 as described above, it is necessary to follow a start-up sequence which powers up the secondary control unit 12 and the NVRAM 15 and initializes both of the control units, this including downloading of information from the NVRAM 15 to the shadow registers in both of the control units so that they are configured to operate in a desired manner. For example, the downloaded information includes parameters for controlling the controlled power supplies, this information being retained in the NVRAM 15 when power is not supplied to the power supply controller 10.

In addition, it is necessary to monitor correct operation of the signal coupling or link between the control units, this being achieved using the link status bit LS as indicated above.

Figure 9:
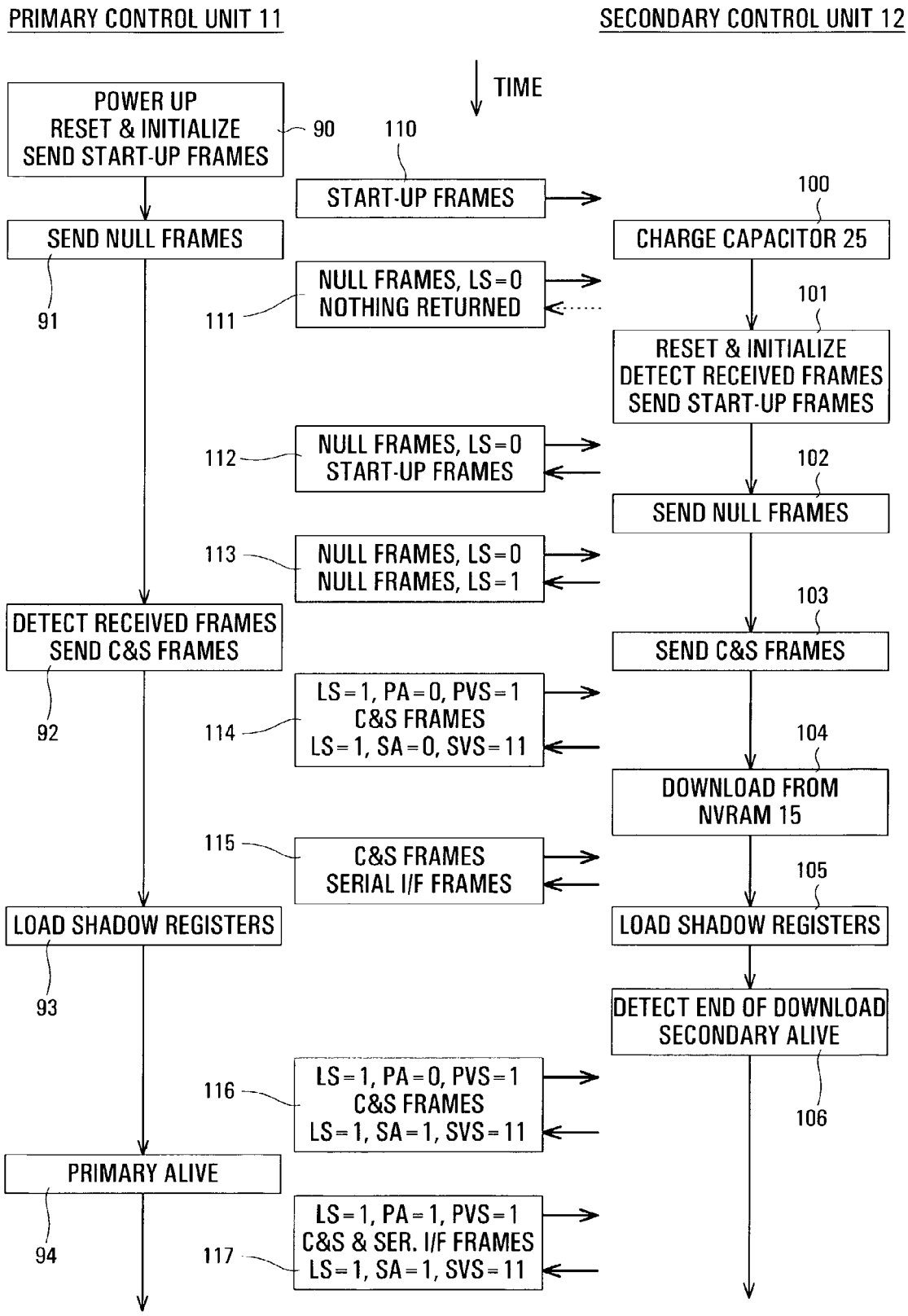
FIG. 9 illustrates a sequence of steps for start-up of the power supply controller using the coupler.

FIG. 9 illustrates a start-up sequence in accordance with one embodiment of the invention. In FIG. 9, operations for the primary control unit 11 are shown at the left in blocks 90 to 94, operations for the secondary control unit 12 are shown at the right in blocks 100 to 106, and horizontal arrows adjacent to blocks 110 to 117 indicate the communication of signals between the control units, in frames as described above, in directions indicated by the arrows. Time advances downwardly in FIG. 9.

Referring to FIG. 9, when power is initially supplied by the power supply 14 to the primary control unit 11, it is powered up and initialized from a reset state (block 90). At this time the capacitor 25 is discharged and there is no supply voltage for the secondary control unit 12 and the NVRAM 15. In order to develop this supply voltage, the primary control unit 11 initially sends start-up frames (block 110) each comprising all 60 bit durations of the period shown in FIG. 4, there being no communication in the opposite direction from the secondary control unit 12 to the primary control unit 11.

The primary control unit 11 enables the outputs of the transmit buffers 21-P during these start-up frames in a manner to increase a duty cycle of the frames progressively from a small value to 100%. This progressive increase in duty cycle serves to limit current flow for charging the capacitor 25 from its initial discharged state, in order to reduce a peak charging current which could otherwise lower the supply voltage of the primary control unit 11 and cause a reset condition.

Consequently, the capacitor 25 is charged (block 100) to create the supply voltage for the secondary control unit 12, and meanwhile the primary control unit 11 completes its sending of start-up frames and starts (block 91) sending null frames (block 111) as described above in which the bit LS=0 to indicate that the primary control unit 11 is not receiving frames via the link. At this time no frames are returned by the secondary control unit 12.

In response to being powered up by the charging of the capacitor 25, the secondary control unit 12 is initialized from a reset state (block 101) and, in response to detecting the null frames from the primary control unit 11, starts to send start-up frames (block 112) to the primary control unit 11 in response to the null frames that it receives. Each of these start-up frames has a duration of 24 bits in accordance with the ping-pong timing of FIG. 4. As in the case of the previous start-up frames from the primary control unit 11, the secondary control unit 12 enables the outputs of the transmit buffers 21-S during these start-up frames in a manner to increase a duty cycle of the frames progressively from a small value to 100%. Again, this progressive increase in duty cycle serves to limit sudden changes in current flow which could otherwise produce adverse conditions.

When the secondary control unit 12 completes its sending of start-up frames, it starts (block 102) sending null frames (block 113) as described above in which the bit LS=1 to indicate that the secondary control unit 12 is properly receiving frames via the link. On proper detection (block 92) of these frames sent by the secondary control unit 12, the primary control unit 11 transitions to sending C&S frames with the bit LS=1, and the secondary control unit 12 accordingly transitions to sending C&S frames with the bit LS=1 (block 114). Each of these C&S frames sent by the primary control unit 11 contains the bit PA=0 to indicate to the secondary control unit 12 that the primary control unit 11 is not yet alive, or in a normal operating state, and the bit PVS=1 to indicate that the primary control unit 11 is initialized and has a proper supply voltage. Similarly, each of these C&S frames sent by the secondary control unit 12 contains the bit SA=0 to indicate to the primary control unit 11 that the secondary control unit 12 is not yet alive, or in a normal operating state, and the bits SVS=11 to indicate proper operating voltages and initialization of the secondary control unit 12.

At this point in the start-up sequence proper communications via the link have been established in both directions, as indicated by the bits LS=1, and each control unit is informed of the other's status. However, neither of the control units is alive, or in a normal operating state, because the information that it requires for normal operation is not yet downloaded from the NVRAM 15.

The secondary control unit 12 initiates the download of information from the NVRAM 15 (block 104) to the shadow registers in both control units, via address and data serial interface (I/F) frames (block 115) via the coupler 13 to the primary control unit 11, which continues to send C&S frames. Accordingly, the downloaded information is loaded into the shadow registers in the primary control unit 11 (block 93) and in the secondary control unit 12 (block 105).

From the address for the NVRAM 15 the secondary control unit 12 detects (block 106) an end of the downloading process, concludes that it is now alive or ready for normal operation, and resumes sending C&S frames (block 116) in which now the bit SA=1. The primary control unit 11 detects this and concludes that its downloading is also finished and that it is also alive (block 94) or ready for normal operation, and sets the bit PA=1 in the C&S frames which it sends (block 117).

Accordingly, the start-up sequence is finished, each of the control units is alive, or in a normal operating state, and each control unit is fully informed of the other's status. Normal operation as described above proceeds, during which serial interface frames can also be communicated via the coupler 13 as also indicated by the block 117.

During normal operation of the control units, the C&S frames communicated between the control units 11 and 12 ensure that each control unit is continuously informed of the status of the other control unit, and thereby can ensure continuous synchronism of the two control units. For example, in the event of the secondary control unit 12 determining, as a result of monitoring an output voltage of a controlled power supply, that the controlled power supply should be shut down, its respective state machine issues a secondary side shut-down command which is communicated to the primary control unit 11 via a respective one of the SSDC bits 74 in the C&S frame 70. The corresponding state machine in the primary control unit 11 is updated accordingly, producing an output signal to disable and thereby shut down the respective controlled power supply, and an acknowledgement of the SSDC bit is returned to the secondary control unit 12 by the corresponding SSDA bit in the C&S frame 60.

As mentioned above, a confidence count is used to determine whether or not received frames are to be used or discarded. For example, frames for which there is a CRC error can be discarded and the confidence count reduced or zeroed, whereas for each received frame for which there is no error the confidence count can be increased, up to a maximum count. The link status is determined in dependence upon the confidence count for the respective receiver; when the confidence count exceeds a threshold, the bit LS=1, and otherwise the bit LS=0. Other detected errors can also be used to affect the confidence count, and/or to reset the control units 11 and 12 so that (after a delay to allow voltages to decay) they repeat the start-up sequence as described above.

In the event that errors result in the bit LS=0 for either of the control units, this is communicated as described above to the other control unit which also clears its link status to LS=0, and both of the control units return to the transmitting null frames as at block 113 in FIG. 9, with LS=0 in each case. For each control unit, on continued error-free receipt of the null frames sent by the other control unit the confidence count is increased, until the threshold is exceeded, the bit LS=1, and the control unit resumes sending C&S frames. Normal operation is then resumed when both control units have the bit LS=1.

Consequently, it can be seen that the link status bit LS communicated in each direction in the frames on the link via the coupler 13 provides a convenient and reliable synchronism of the states of the two control units, this also being facilitated by the alive bit PA or SA in the C&S frames. In addition, the commands and acknowledgements in the C&S frames ensure that the state machines of the two control units remain synchronized.

In addition, each of the two control units includes a so-called watch-dog timer (WDT) to check proper operation of the control units. As various bits of the frames as described above constitute explicit messages, each control unit must receive a respective message to update a change in status, and otherwise assumes that there is no such change and that the last received message represents the current status for the respective parameter. In the event that a control unit receives no messages, its WDT expires to reset this control unit, producing a reset of the other control unit as described above.

Although a particular embodiment of the invention is described above in detail, it can be appreciated that this is by way of example only and numerous changes can be made.

For example, the numbers of bits in each frame and in the ping-pong period are selected to provide a desired bit rate for signal coupling via the coupler 13, consistent with a desirably low clock rate, sufficient power transfer to the secondary side, and sufficiently small voltage sag of the capacitor 25 when power is not being transferred from the primary to the secondary side of the transformer 20. These and other parameters may be varied to suit particular situations.

In particular, in the event that a synchronous arrangement of the two control units 11 and 12 is provided instead of the asynchronous arrangement as described above, the ping-pong timing may be changed to eliminate the inter-frame gaps and the PS fill 44, and the forms of the C&S frames can be modified, to take advantage of the synchronous operation.

In addition, although the invention is described above in the context of a power supply controller, the invention is not limited to this application but can also be used in other signal coupling applications.

Thus although particular embodiments of the invention and examples have been described above in detail, it can be appreciated that numerous modifications, variations, and adaptations may be made without departing from the scope of the invention as defined in the claims.

The invention claimed is:

1. A method of coupling signals between first and second units via a transformer, comprising the steps of:

deriving a power supply for the second unit from signals coupled from the first unit to the second unit;

initially coupling signals via the transformer from the first unit to the second unit to charge a power supply capacitor of the second unit thereby to produce a power supply voltage for the second unit;

subsequently coupling signals in signal frames from the first unit to the second unit; and in response to signal frames received by the second unit from the first unit, coupling signals in signal frames from the second unit to the first unit;

wherein the signal frames coupled from each unit comprise a signal indicating whether or not signal frames are correctly received from the other unit.

2. A method as claimed in claim 1 and comprising the step of progressively increasing, from a relatively small value, a duty cycle of the signals coupled initially from the first unit to the second unit to charge the power supply capacitor of the second unit.

3. A method as claimed in claim 1 wherein the signal frames are coupled alternately in opposite directions from each unit.

4. A method as claimed in claim 3 and including the step of each unit providing a delay after receiving a signal frame from the respective other unit before coupling a signal in the opposite direction to the respective other unit.

5. A method as claimed in claim 3 wherein the second unit operates asynchronously to the first unit, the method including the steps of:

determining a ping-pong period in the first unit, each signal frame coupled from the first unit to the second unit being provided in a first part of the ping-pong period; and following receipt of a signal frame coupled from the second unit to the first unit in a second part of the ping-pong period following the first part of the ping-pong period, coupling a fill signal from the first unit to the second unit for any remainder of the ping-pong period.

6. A method as claimed in claim 5 and including the step of each unit providing a delay after receiving a signal frame from the respective other unit before coupling a signal in the opposite direction to the respective other unit.

7. A method as claimed in claim 1 wherein the signal frames coupled from each unit further comprise a signal indicating whether or not the respective unit has a proper supply voltage.

8. A method as claimed in claim 1 wherein the signal frames coupled from each unit further comprise a signal indicating whether or not the respective unit is ready for normal operation.

9. A method as claimed in claim 1 wherein the signal frames coupled from each unit further comprise a plurality of signals indicating commands issued by the respective unit and acknowledgements of said commands by the respective other unit.

10. A method as claimed in claim 9 wherein the first and second units comprise control units for coupling to primary and secondary sides, respectively, of a plurality of isolating power supplies, and said commands comprise control signals for said isolating power supplies.

11. A method as claimed in claim 1 wherein the signal frames coupled from the second unit to the first unit comprise addresses and data for transferring information stored in a non-volatile memory via the transformer to the first unit.

12. A method as claimed in claim 11 and including the step of providing a power supply to the non-volatile memory from said power supply capacitor.

13. A method of operating a power supply controller comprising first and second control units for coupling to primary and secondary sides, respectively, of a plurality of isolating power supplies controlled by the power supply controller, the first and second control units being coupled via a transformer for coupling signals in both directions between the first and second control units and for producing a power supply for the second control unit from signals coupled from the first control unit to the second control unit, comprising the steps of:

initially coupling signals via the transformer from the first control unit to the second control unit to charge a power supply capacitor of the second control unit thereby to produce a power supply voltage for the second control unit; and subsequently coupling signals, for operation of the control units to control the plurality of isolating power supplies by the power supply controller, in signal frames in alternating directions between the first and second control units, the signal frames coupled from each control unit comprising a signal indicating whether or not signal frames are correctly received from the other control unit.

14. A method as claimed in claim 13 and comprising the step of progressively increasing, from a relatively small value, a duty cycle of the signals coupled initially from the first control unit to the second control unit to charge the power supply capacitor of the second control unit.

15. A method as claimed in claim 14 wherein the second control unit operates asynchronously to the first control unit, the method including the steps of:

determining a ping-pong period in the first control unit, each signal frame coupled from the first control unit to the second control unit being provided in a first part of the ping-pong period; and following receipt of a signal frame coupled from the second control unit to the first control unit in a second part of the ping-pong period following the first part of the ping-pong period, coupling a fill signal from the first control unit to the second control unit for any remainder of the ping-pong period.

16. A method as claimed in claim 15 and including the step of each control unit providing a delay after receiving a signal frame from the respective other control unit before coupling a signal in the opposite direction to the respective other control unit.

17. A method as claimed in claim 13 wherein the signal frames coupled from each control unit further comprise a signal indicating whether or not the respective control unit has a proper supply voltage.

18. A method as claimed in claim 13 wherein the signal frames coupled from the second control unit to the first control unit comprise addresses and data for transferring information stored in a non-volatile memory via the transformer to the first control unit.

19. A method as claimed in claim 18 and including the step of providing a power supply to the non-volatile memory from said power supply capacitor.

20. A method as claimed in claim 13 wherein the signal frames coupled from the second control unit to the first control unit comprise a plurality of signals indicating commands for respective isolating power supplies, and the signal frames coupled from the first control unit to the second control unit comprise a corresponding plurality of signals indicating acknowledgements of said commands.

21. A method as claimed in claim 13 wherein the signal frames coupled from the first control unit to the second control unit comprise at least one signal indicating enable and shut-down commands for the isolating power supplies, and the signal frames coupled from the second control unit to the first control unit comprise at least one corresponding signal indicating an acknowledgement of said commands.

* * * * *